United States Patent [19]

Garrido

[11] 4,188,134

[45] Feb. 12, 1980

[54] RIBBON CARTRIDGE HAVING CAM MEANS FOR MOVING RIBBON SENSING AND REVERSING LEVER

[75] Inventor: John A. Garrido, Manalapan, N.J.

[73] Assignee: Litton Business Systems, Inc., Morris Plains, N.J.

[21] Appl. No.: 848,136

[22] Filed: Nov. 3, 1977

[51] Int. Cl.[2] ..... B41J 33/14

[52] U.S. Cl. ..... 400/208

[58] Field of Search ..... 400/207, 208, 208.1, 400/242, 202.4; 242/71, 71.2

[56] References Cited

U.S. PATENT DOCUMENTS

| | | | |
|---|---|---|---|
| 1,561,945 | 11/1925 | Penin | 242/71.2 |
| 2,099,646 | 11/1937 | Busch | 242/71 |
| 2,986,260 | 5/1961 | Whippo | 400/208 |
| 3,151,724 | 10/1964 | Ross et al. | 400/208.1 |
| 3,272,304 | 9/1966 | Morelli | 400/208.1 |
| 3,346,090 | 10/1967 | Goff et al. | 400/208 |
| 3,396,829 | 8/1968 | Knight | 400/202.4 |
| 3,513,957 | 5/1970 | Ricciardi et al. | 400/208 |
| 3,604,549 | 9/1971 | Caudill et al. | 400/208 |
| 3,889,795 | 6/1975 | Garberi et al. | 400/208 |
| 3,977,511 | 8/1976 | Hengelhaupt | 400/207 X |
| 4,033,445 | 7/1977 | Oddicini | 400/208 |
| 4,083,444 | 4/1978 | Salto | 400/208 |

*Primary Examiner*—Ernest T. Wright, Jr.

*Attorney, Agent, or Firm*—Norman Friedman; Robert F. Rotella

[57] ABSTRACT

A ribbon cartridge is adapted for insertion into a printing machine such as a printing electronic calculator having a printer, a platen, and a ribbon quantity sensing and reversing lever. The cartridge comprises a cassette with an inked ribbon therein connected between two ribbon storage members. The cassette has ribbon guide members for directing the ribbon from one ribbon storage member in between the printer and platen to another ribbon storage member. The ribbon cartridge is improved by incorporating as a part of the cassette a member or members for moving the lever into a non-interfering position during the insertion of the cartridge into the printing machine, the member(s) being positioned below the operating plane of the lever upon complete insertion of the cartridge.

14 Claims, 6 Drawing Figures

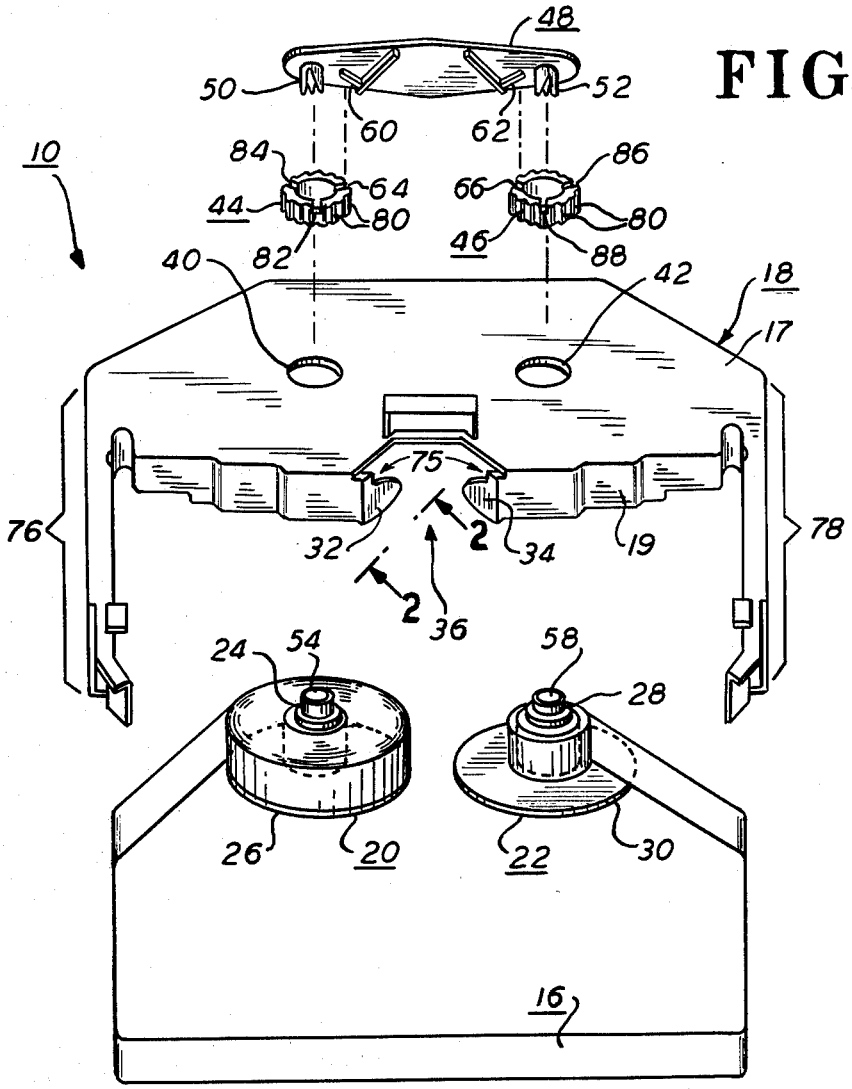
FIG. 1
FIG. 3
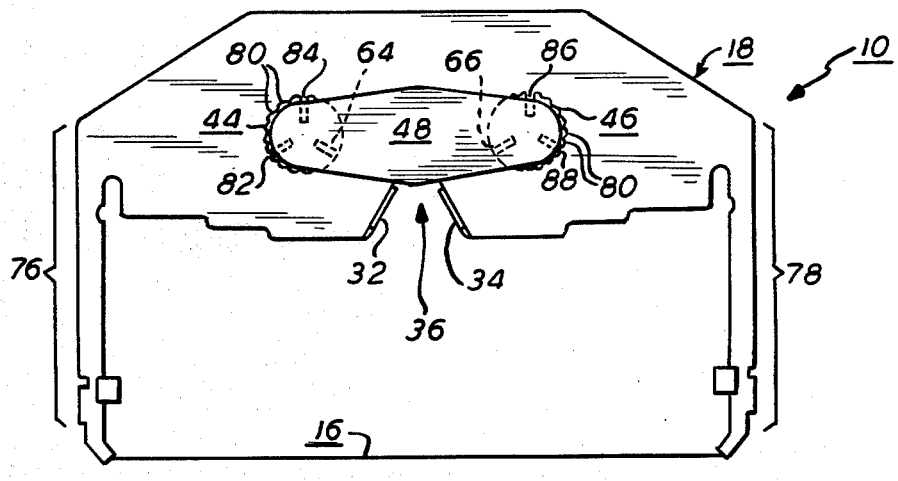

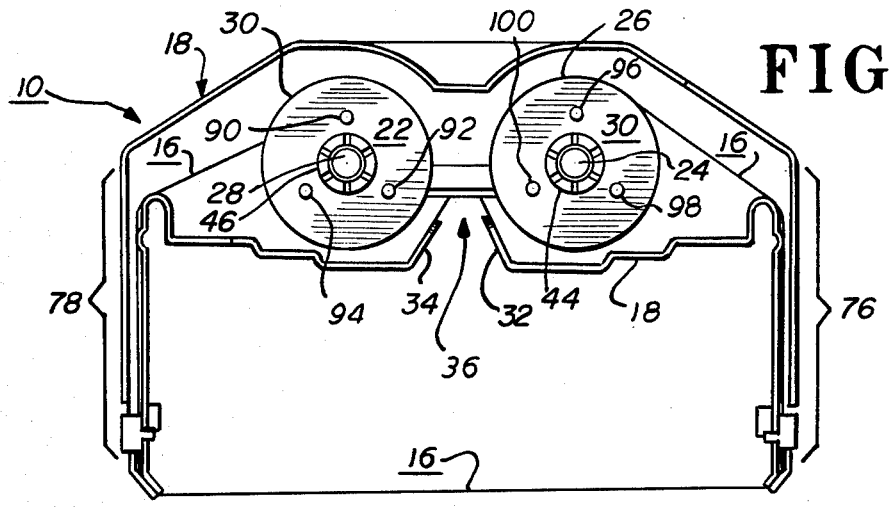
FIG. 4
FIG. 6
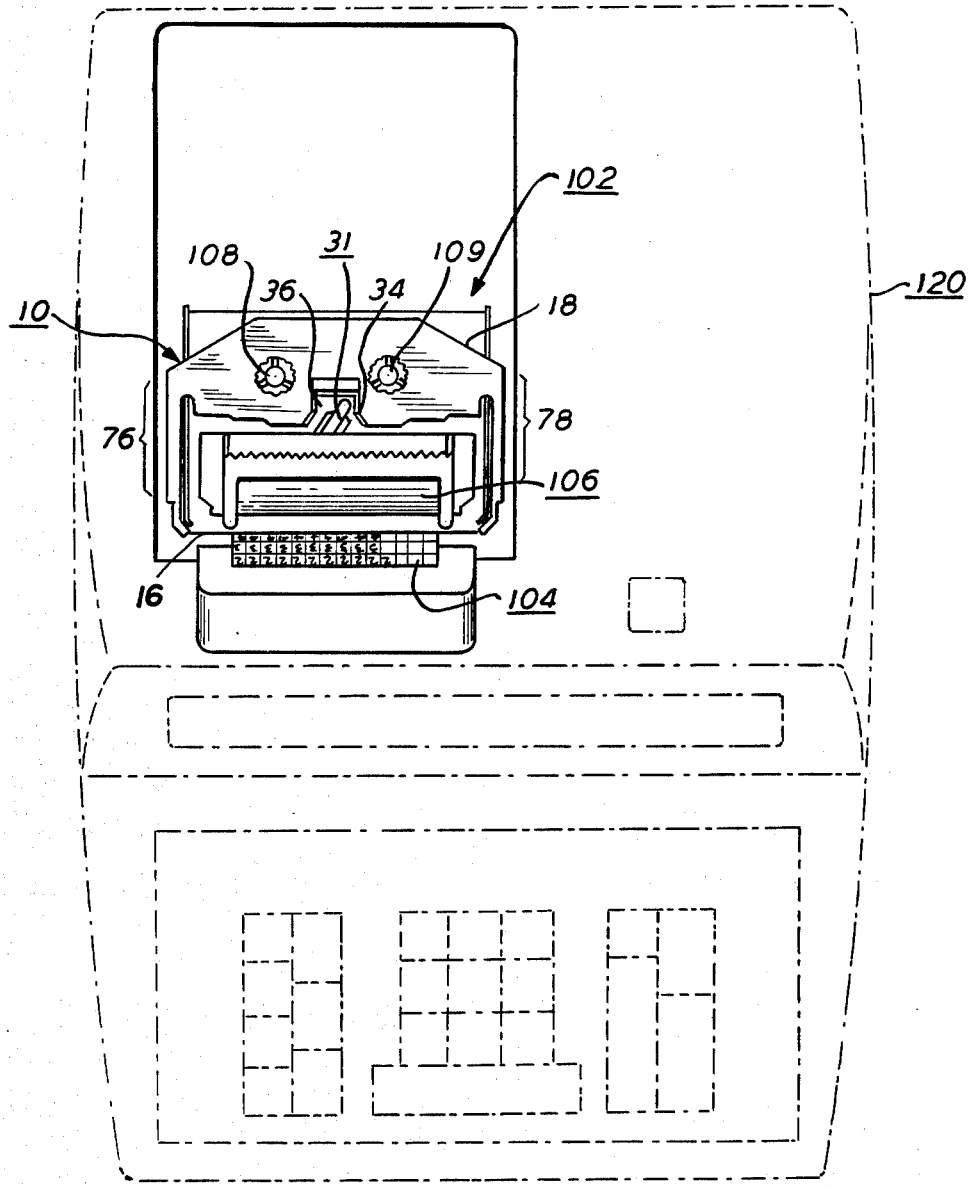

RIBBON CARTRIDGE HAVING CAM MEANS FOR MOVING RIBBON SENSING AND REVERSING LEVER

CROSS-REFERENCES TO RELATED APPLICATIONS

This application is related to copending applications, all assigned to the assignee of the present application and entitled "Ribbon Cartridge", bearing Ser. No. 852,297, filed on Nov. 17, 1977, in the name of Joseph C. Sereika; Ser. No. 852,298, filed on Nov. 17, 1977, in the name of Joseph A. Marsico; and Ser. No. 853,556, filed on Nov. 21, 1977, in the name of Myron Beitler.

BACKGROUND OF THE INVENTION (1) Field of the Invention

This invention relates to an improved ribbon cartridge for use in a printing machine, and more particularly, for use in an electronic printing calculator. Specifically, the invention relates to a ribbon cartridge having a self-contained inked ribbon therein adapted for convenient insertion into the printing machine.

(2) Description of the Prior Art

The usual construction of a calculator printing mechanism, whether electronic or manual, prevents insertion of a ribbon in a self-contained cartridge. A mechanism of the type referred to herein is comprised of an obstructing reversing member located in between gears with axles attached thereto. These gears with the axles attached are laterally spaced from each other. The gears are located in the same plane and the axles are located parallel to one another in a plane orthogonal to that of the gears. Usually, a spool with an inked ribbon is placed and stored on one of the axles and another spool for taking up the ribbon is placed and stored on the other axle. When all of the ribbon is taken up, this event is sensed or detected by the reversing member which operates laterally in a plane parallel to the gears, and the respective roles of the spools are reversed.

The ribbon travels from one of the spools in between a platen and printer to the other spool and usually must be loaded in the mechanism by hand. An operator inserting exposed spools with inked ribbon thereon into the printing mechanism routinely receives soiled hands from the ink in the ribbon. Moreover, the procedure for inserting both of the spools and threading the ribbon in between the platen and printer is often-times cumbersome and time-consuming, wasting a considerable amount of valuable operator time.

Ribbon cartridges containing spools of inked ribbon have been heretofore constructed. However, one problem with these previously constructed ribbon cartridges is that they also have been difficult and cumbersome to insert into the printing mechanism because a member for sensing the quantity of ribbon on each spool (often combined with a reversing mechanism) is located within the printing mechanism between the spools. The member may be designed to operate by resting against either the unfilled or filled spool. If it is against the unfilled spool, as the unfilled spool fills up with ribbon the lever is gradually forced toward the central region between the two axles. When the take-up spool is substantially filled the lever is forced back toward the now unfilled spool, at the same time reversing the drive mechanism such that the ribbon, instead of traveling from the first initially filled spool to the unfilled spool, is now driven from the filled spool toward the now unfilled spool. Similarly, the lever can be fashioned such that reversal of movement occurs with the lever resting against a depleted spool. The lever can be spring loaded against the filled spool so as to trigger reversal of the spool movement and then pivot to the filled spool after it comes within a predetermined range of the axle of the filled spool.

Heretofore a calculator operator desiring to change the ribbon had to use an external and separate tool or other means such as a hand for moving the reversing lever out of the way of the cartridge to be inserted. This has been a most cumbersome and tedious procedure because of the small space which the operator has available in which to manipulate fingers for moving the lever out of the way.

SUMMARY OF THE INVENTION

The present invention, an improvement in a self-contained ribbon cartridge, has eliminated the foregoing problems by integrating a novel camming means for automatically repositioning the sensing lever which acts during insertion such that the lever does not interfere with or obstruct the insertion of the cartridge. After insertion, the camming means is located below the operating plane of the lever and does not interfere with movement of the lever.

This invention will be described with more particularity by reference to the following specification and drawing.

In the Drawing

FIG. 1 is an exploded view of an example of the invention.

FIG. 3 is a top view of an assembled example of the invention.

FIG. 4 is a bottom view of an assembled example of the invention.

FIG. 6 is a view of the invention in combination with a printing electronic calculator.

DESCRIPTION OF A PREFERRED EMBODIMENT

Figure 2:
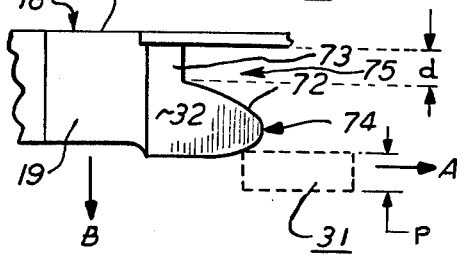
FIG. 2 is a magnified view of an aspect of the invention taken along section line 2—2 in FIG. 1.

Shown in FIG. 1 is an exploded view of a preferred embodiment of the invention. A ribbon cartridge 10 comprises at least two means for storing ribbon and a means for housing said ribbon and the ribbon storing means.

The ribbon storing means may be comprised of ribbon storing spools 20 and 22 made of plastic, for example. The spool 20 comprises a spindle 24 and a flange 26 located at one end of the spindle 24. Spool 22 has a spindle 28 and a flange 30 located at one end of the spindle 28. The ribbon 16 has one end connected to the spindle 24 and another end connected to the spindle 28.

The means for housing the ribbon 16 may be comprised of a generally C-shaped cassette 18 having a plastic housing, including an upper cover 17 and a side wall 19 extending downwardly from the upper cover 17, thereon and, as shown in FIGS. 1 and 2, means for moving a ribbon quantity sensing and ribbon reversing member such as a lever 31 (shown in cross-section in FIG. 2), which is attached to a printing mechanism (see FIG. 5) such that it does not obstruct the insertion of the cartridge 10 into the printer. This means for repositioning the ribbon quantity sensing and ribbon reversing member 31 may be comprised of a first cam 32 and a second cam 34 integrally attached to the cassette 18.

Figure 5:
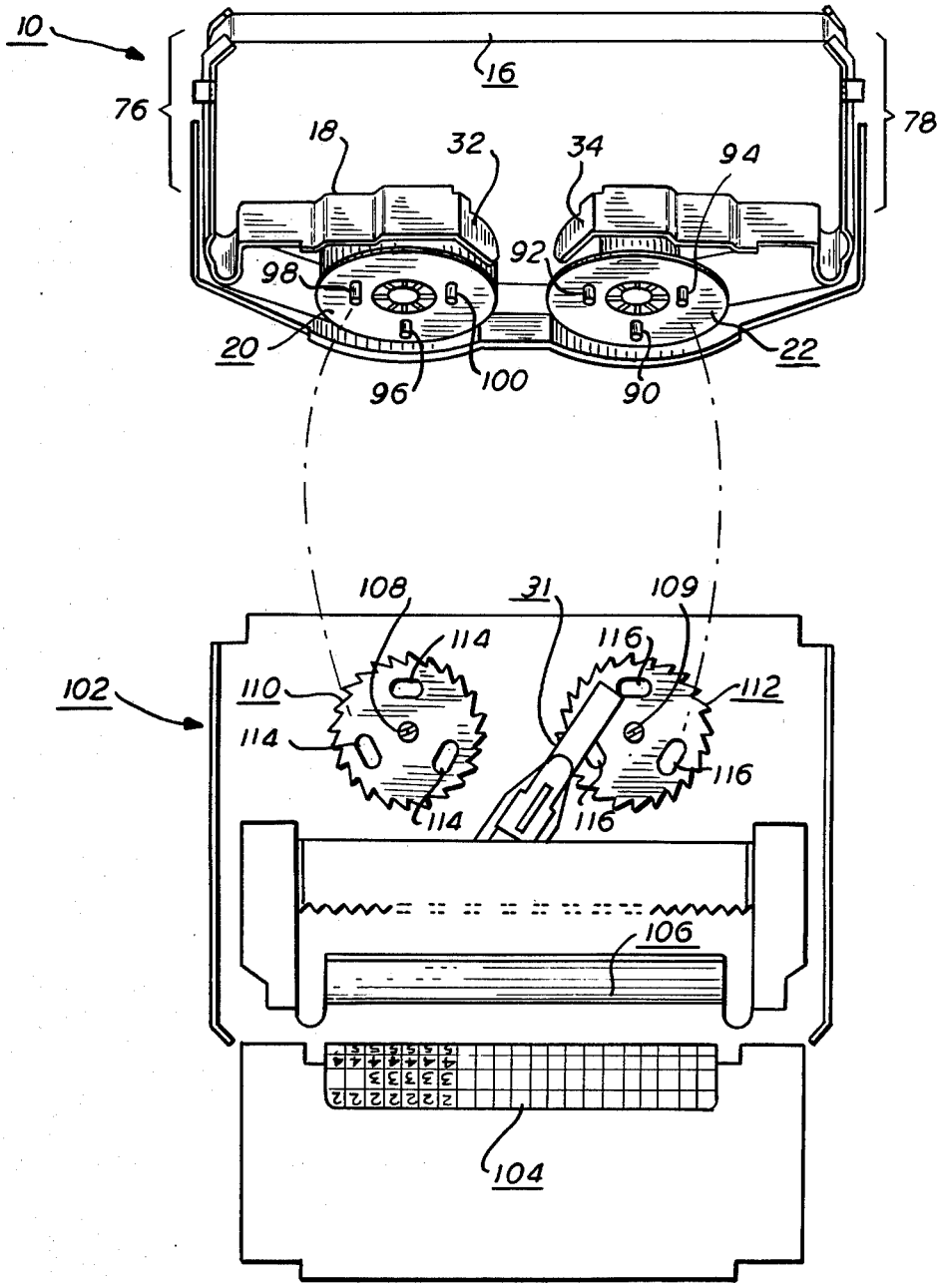
FIG. 5 is a modified perspective view of an example of the invention in combination with a printing mechanism.

The cassette 18 has an opening 36 into which the sensing lever 31 is directed by the action of the cams 32 and 34 upon insertion of the cartridge 10 into the printing mechanism (see FIG. 5).

The cassette 18 is bilaterally symmetric with respect to the opening 36 and has an open side, usually referred to as a bottom. The cam 32 is attached to one bilaterally symmetric half of the cassette 18 and the cam 34 is attached to another bilaterally symmetric half of the cassette 18 and extends to and borders the bottom of the cassette 18. Similarly, the cassette 18 has two bilaterally symmetric apertures 40 and 42 therein. The spindle 24 of the spool 20 is inserted through the aperture 40 and attached to the cassette 18 by a fastening means such as a ridged knob 44, for example. The spindle 24 is designed and adapted such that when fastened to the cassette 18 by the ridged knob 44, the spool 20 rotates freely within the aperture 40.

In a like manner, the spindle 28 of the spool 22 is inserted through the aperture 42 and fastened to the cassette 18 by a fastening means such as a ridged knob 46, for example. The spindle 28 is adapted for insertion through the aperture 42 and fastening therein by the ridged knob 46 in a fashion so as to permit the spool 22 to rotate freely.

Referring to FIG. 1, the spindle 28 may be characterized as having three distinct sections each having a different diameter, the diameters decreasing in size from the flange 30 toward the smallest diameter section onto which the knob 46 is fitted. The middle section of the spindle 28 is adapted to rotatably fit through the aperture 42.

The spindle 24 may be similarly characterized, and its middle section is adapted to rotatably fit through the aperture 40.

For proper insertion of the cartridge 10 and seating of the cartridge 10 in the printing mechanism 102 (see FIG. 5), means for holding the ribbon 16 taut as it is extended from the spool 20 to the spool 22 is required. An example of this means is a member 48. The member 48 comprises two attached protruding members 50 and 52 which are adapted for insertion into apertures 54 and 58 in the spindles 24 and 28, respectively. Members 50 and 52 are each a tripartite structure with sufficient flexibility for tightly and removably fitting into the respective apertures 54 and 58 and immobilizing the spools 20 and 22 from rotation in the apertures 40 and 42, respectively.

The means for immobilizing the spools 20 and 22 from rotation, namely the member 48, further comprises a means for locking the spools 20 and 22 into a preselected and preferred position with respect to the cassette 18 and the member 48. This locking means comprises a pair of ridges 60 and 62 preferentially disposed on the member 48. These ridges 60 and 62 are designed and adapted to fit into the ridged knobs 44 and 46 at at least one preselected and preferred location on each at which grooves 64 and 66, respectively, have been formed therein. These grooves 64 and 66 are designed and adapted to receive and retain the ridges 60 and 62, respectively, in a manner which locks the ridged knobs 44 and 46, respectively, into the preselected and preferred positions. This in turn locks the spools 20 and 22, respectively, into position since their spindles 24 and 28, respectively are fixed in position by their frictional attachment to the knobs 44 and 46, respectively.

FIG. 2 shows a magnified view of the cam 32 shown in FIG. 1 as viewed along the section line 2—2. The cam 32 is substantially a mirror image of the cam 34. The cams 32 and 34 are obliquely oriented with respect to each other and cooperate to move a ribbon quantity sensing and reversing lever 31 into the aperture 36 centrally located in the cassette 18 only during insertion of the cartridge 10. After insertion the cams 32 and 34 are below the operating plane of the lever 31. Each of cams 32 and 34 has a camming surface 72 which is designed such that it can transversely contact the lever 31 and move the lever 31 in a direction A as the cassette 18 is inserted into a printing mechanism by pressing in the direction B. It is essential that each camming surface 72 is spaced below the operating space and plane of the lever 31 after the cassette 18 is inserted and that the cassette 18 not interfere with movement of the lever 31 against either of the ink ribbon spools 20 and 22. This has been accomplished by providing a thin spacer 73 integral with the cassette 18 and the cam 32 and defining a recess 75 having a vertical length d at least equal to the thickness p of the lever 31.

The cam 34 is similarly constructed and also operates in this manner, but would move the lever 31 in a direction opposite to A.

The lever 31, when moved by either cam 32 or 34 comes to rest in a preferred position, a position which has been preselected by the arrangement, curvature, and extension of the cams 32 and 34. The lever 31 occupies a space which is complementary to a space occupied by the cartridge 10 in the printing mechanism, i.e. a nonobstructing space adjacent to that space occupied by the cartridge 10. As the cartridge 10 is pressed into a printing mechanism 102, if for example the sensing lever 31 is against the spool 20, the lever 31 is pivoted away from the spool 20 in the direction A until the lever 31 is in the aperture 36 or rests against the apex 74 of the cam 32 or a similar apex of the cam 34.

A camming surface 72 of the cam 32 may be characterized as either arcuate or substantially parabolic in shape. However, this shape is not critical to the function of the cams 32 and 34 as set forth herein and other shapes for similar members may accomplish movement of the lever 31 into an unobstructing position with respect to the cartridge 10. Each of cams 32 and 34 is designed to move the lever 31 simultaneously with the inserting movement of the cartridge 10 into the printing mechanism.

A top view of the cartridge 10 as assembled is shown in FIG. 3. There is shown the cassette 18 with an integral means for guiding the ribbon 16 away from a main body of the cassette 18 to a remote location within a printing mechanism 102. This guide means facilitates insertion of the ribbon 16 into a printing mechanism of the type comprising a platen and a printer in between which the ribbon 16 must travel. The guide means comprises arms 76 and 78 through which the ribbon 16 travels and is guided away from the spool 20 toward the spool 22 (and vice versa when the direction of travel of the ribbon 16 is reversed).

Referring to FIGS. 1 and 3, parallel indentations 80 may be observed on the knobs 44 and 46. These indentations 80 facilitate gripping the knobs 44 and 46 for adjustments. In addition to the grooves 64 and 66 covered by the member 48, there exist other similar grooves 82 and 84 on the knob 44 and additional similar grooves 86 and 88 on the knob 46.

As shown in FIG. 4, the ridged knob 44 is attached to the spindle 24 of the spool 20 in a manner such that the grooves 82, 84, and 64 correspond respectively to the three protruding members 96, 98, and 100 attached to the flange 26 of the spool 20. Likewise, the ridged knob 46 has grooves 86, 88, and 66 which correspond to protruding members 90, 92, and 94 directly underneath on the flange 30 of the spool 22.

FIG. 5 shows the ribbon cartridge 10 in relationship to a printing mechanism 102. The spools 20 and 22 are locked into a preselected and preferred position and immobilized. The spools 20 and 22 are locked in a manner which maintains the ribbon 16 taut and facilitates and improves insertion of the cartridge 10 into the printing mechanism 102.

The printing mechanism 102 is comprised of a printer 104, a platen 106, and laterally spaced axles 108 and 109 positioned so as to receive the spools 20 and 22 held within the cassette 18 of the ribbon cartridge 10. The axles 108 and 109 have attached thereto geared flanges 110 and 112, respectively. The geared flange 110 has openings 114 therein arranged and spaced so as to receive the protruding members 96, 98 and 100 of the spool 20 when the spool 20 is oriented by the member 48 (see FIGS. 1 and 3). Likewise, the geared flange 112 has openings 116 therein which are arranged and spaced so as to receive each of the protruding members 90, 92 and 94 of the spool 22 when the protruding members 90, 92 and 94 and geared flange 112 are each in their aforedescribed preferred and preselected position.

Shown in full view in FIG. 5 is the lever 31 which senses the amount of the ribbon 16 adjacent either the axle 108 or the axle 109 and shifts to the opposite one of the axles 108 and 109 when the spool 20 or 22 which the lever 31 is most proximate to, becomes full. When the lever 31 moves to the opposite one of the axles 108 and 109 of the ribbon spools 22 and 20, respectively, the movement of the lever 31 activates a mechanism (not shown) which reverses the direction of movement of the ribbon 16.

Shown in FIG. 6 is the cartridge 10 in combination with the printing mechanism 102 as part of an electronic printing calculator 120. The cartridge 10 is shown with the cassette 18 within the housing of the printing mechanism 102. As heretofore mentioned, the arms 76 and 78 guide the ribbon 16 away from the main body of the cassette 18 in between the printer 104 and the platen 106. The ribbon quantity sensing and reversing lever 31 is visible in the aperture 36 of the cassette 18. The lever 31 rests against the cam 34 and in a position most proximate to the axle 109.

As many other embodiments of the invention may be made and as many changes in the preferred embodiment above disclosed are possible, it will be understood that the foregoing is to be interpreted in an illustrative rather than limiting sense and that various omissions and substitutions and changes in the form or details of the structure of the device illustrated and in its operation may be made by those skilled in the art without departing from the spirit of the invention.

It is the intention therefore to be limited only as indicated by the following claims.

What is claimed is:

1. In a ribbon cartridge for insertion into a printing mechanism having a ribbon quantity sensing and reversing lever movable between at least one operative position in which the ribbon quantity sensing and reversing lever obstructs the insertion of the cartridge and at least one inoperative position in which the ribbon quantity sensing and reversing lever is rendered unobstructing, wherein the cartridge comprises a cassette having an inked ribbon therein, an improvement wherein the cassette comprises means rigid with the cassette and engageable with the ribbon quantity sensing and reversing lever for moving the ribbon quantity sensing and reversing lever into the inoperative position in the printing mechanism during insertion of the cartridge.

2. A ribbon cartridge according to claim 1 wherein the means for moving the ribbon quantity sensing and reversing lever is integral with the cassette.

3. A ribbon cartridge according to claim 1 further comprising means for receiving the ribbon quantity sensing and reversing lever in at least one operative position when the cartridge has been inserted in place.

4. A ribbon cartridge according to claim 3 wherein the means for moving the ribbon quantity sensing and reversing lever comprises a first cam for contacting one side of the lever and a second cam for contacting another side of the lever.

5. A ribbon cartridge according to claim 4 wherein the cassette comprises a housing, the first and second cams are integral with and disposed below the housing and have first and second camming suraces, respectively, which are spaced apart from the housing and cooperate with the housing to define first and second recesses, respectively, between the housing and the first and second camming surfaces, respectively, and the means for receiving the ribbon quantity sensing and reversing lever in at least one operative position when the cartridge has been inserted comprises one of the first and second recesses.

6. In a ribbon cartridge, comprising a cassette, having an inked ribbon therein connected between two ribbon storage means, for insertion in a first direction into a printing mechanism having two spaced-apart means for driving the ribbon storage means and an obstructing member movable only between the two means for driving the ribbon storage means, the obstructing member being movable in a second direction in a plane which is substantially perpendicular to the first direction between a first position in which the member obstructs the insertion of the cartridge and at least one second position in which the member is rendered unobstructing, an improvement wherein the cassette also comprises means for moving the obstructing member in the second direction into the second position in the printing mechanism during the insertion of the cartridge.

7. A ribbon cartridge according to claim 6 further comprising means for receiving the obstructing member in the first position when the cartridge has been inserted.

8. A ribbon cartridge according to claim 7 wherein the means for moving the obstructing member is integral with the cassette.

9. A ribbon cartridge according to claim 8 wherein the means for moving the obstructing member directly contacts the obstructing member.

10. A ribbon cartridge according to claim 8, wherein the means for moving the obstructing member comprises a first cam for contacting one side of the obstructing member and a second cam for contacting another side of the obstructing member.

11. A ribbon cartridge according to claim 10, wherein the cams each have an arcuate camming surface with a portion for contacting the obstructing member.

12. A ribbon cartridge according to claim 11, wherein the cams are obliquely oriented with respect to each other.

13. A ribbon cartridge according to claim 12, wherein each cam is oriented to transversely contact the obstructing member.

14. A ribbon cartridge according to claim 13, wherein the obstructing member is a ribbon quantity sensing and reversing lever.

* * * * *

UNITED STATES PATENT AND TRADEMARK OFFICE

CERTIFICATE OF CORRECTION

PATENT NO. : 4,188,134

DATED : February 12, 1980

INVENTOR(S) : John A. Garrido

It is certified that error appears in the above—identified patent and that said Letters Patent is hereby corrected as shown below:

Column 4, line 55, after "mechanism" delete "102"

line 56, after "mechanism" insert --102--

Column 5, line 25, after "98" insert a comma --,-- line 29, after "92" insert a comma --,--

Column 6, line 27, change "suraces" to --surfaces--

Signed and Sealed this

Tenth Day of June 1980

[SEAL]

Attest:

SIDNEY A. DIAMOND

Attesting Officer

Commissioner of Patents and Trademarks